US006126065A

United States Patent [19]

Wee

[11] Patent Number: 6,126,065

[45] Date of Patent: Oct. 3, 2000

[54] CONTAINERS

[76] Inventor: Lau Boon Wee, 11 West Coast Park, Singapore, 127635, Singapore

[21] Appl. No.: 09/142,711

[22] PCT Filed: Mar. 10, 1997

[86] PCT No.: PCT/SG97/00009

§ 371 Date: Nov. 9, 1998

§ 102(e) Date: Nov. 9, 1998

[87] PCT Pub. No.: WO97/33796

PCT Pub. Date: Sep. 18, 1997

[30] Foreign Application Priority Data

Mar. 11, 1996 [SG] Singapore ..... 9602195

[51] Int. Cl.[7] ..... B65D 5/20

[52] U.S. Cl. ..... 229/114; 229/117.08; 229/145

[58] Field of Search ..... 229/114, 117.07, 229/117.08, 128, 145, 902, 906

[56] References Cited

U.S. PATENT DOCUMENTS

| | | | |
|---|---|---|---|
| Re. 33,979 | 6/1992 | Cortopassi | 229/114 |
| 1,090,559 | 3/1914 | Morrison | 229/145 |
| 1,148,219 | 7/1915 | Cornell | 229/117.08 |
| 1,681,940 | 8/1928 | Lander | 229/114 |
| 1,866,317 | 7/1932 | Miner | 229/114 |
| 3,377,017 | 4/1968 | Rosenfield | 229/114 |
| 5,402,930 | 4/1995 | Storms et al. | 229/114 |

*Primary Examiner*—Gary E. Elkins
*Attorney, Agent, or Firm*—Abelman, Frayne & Schwab

[57] ABSTRACT

A container (10) comprises a base member (11) and a lid (12) which are co-operable to form a closed box. The base member (11) has side walls (14) tapering outwardly therefrom. The lid member (12) comprises side walls (17) tapering inwardly therefrom. Crease lines (18, 19) are provided to allow some of the side walls (14, 17) to flex thereby enabling the inwardly tapering walls of the lid member to be fitted over the outwardly tapering walls of the base member.

24 Claims, 6 Drawing Sheets

CONTAINERS

The present invention relates to containers which can be secured in the closed condition without the need for additional fastening means such as an elastic band or adhesive tape. The invention is particularly useful for containers for foodstuffs but is equally applicable to containers for any other type of merchandise.

Conventional containers for merchandise typically consist of straight sided boxes with lids which simply fit over the top of the box. Such boxes must often be secured in a closed condition with additional means such as an elastic band or tape in order to prevent the lids simply slipping off again. Other conventional containers are closed by tabs which tuck into slots or interlock with other tabs. These types of fastening means are often awkward to engage and certain types are not very reliable at keeping the container securely closed. Furthermore, straight sided boxes or clamshell type boxes do not perform wall under compression, for example it stacked one on top of another. In the case of straight sided containers, the sides tend to bow outwardly causing the container to open. With clamshell boxes, compression tends to crush the boxes and break the locking tab.

The present invention provides a container comprising a base member and a lid member co-operable to form a closed box, wherein the base member comprises at least one outwardly tapering wall and the lid member comprises at least one inwardly tapering wall and wherein means is provided to allow either the outwardly tapering wall to flex inwardly or the inwardly tapering wall to flex outwardly so as to enable the inwardly tapering wall to be fitted over the outwardly tapering wall.

Preferably, the means to allow flexing comprises at least one crease line formed in the wall to be flexed.

In a preferred embodiment, the base member comprises at least three outwardly tapering walls and the lid member comprises at least three inwardly tapering walls.

Advantageously, the outwardly tapering wall tapers at an angle in the range of 8 to 15° and most preferably at about 11°. Similarly, the inwardly tapering wall preferably tapers at an angle in the range of 8 to 15° and most preferably at an angle of about 11°.

In one aspect of the invention the base member and the lid member are integral with one another, being joined along a hinge line.

In another aspect of the invention, the base member and the lid member are separate from one another.

The depth of the outwardly tapering wall may be substantially equal to the depth of the inwardly tapering wall. Alternatively, the depth of the outwardly tapering wall may be substantially greater than the depth of the inwardly tapering wall.

Preferably, the container is constructed either from stiff paper, cardboard or plastics material. Moreover, the container can be constructed from a laminated material.

In one aspect of the invention, each wall of the base member is formed integrally with the adjacent walls and with a base panel.

Similarly, each wall of the lid member may be formed integrally with the adjacent wall or walls and a lid panel. In this way, no gaps are created at the corners of the container thus ensuring it is leak proof if liquids are contained within it.

Preferably, adjacent walls and the base panel or lid panel are integrally formed by means of a flap which extends therebetween.

In another aspect of the invention, at each corner of the container one wall is formed with a flap which is attachable to the adjacent wall in order to form a joint. This simpler form of joint can be used when the container is not required to be leak proof.

In yet another aspect of the present invention, the container is provided with means to allow it to be collapsed into a substantially flat condition for convenient and space efficient storage.

Conveniently, the container is formed with at least one crease line in at least one wall of the lid member and of the base member in order to facilitate collapse into the flat condition.

In a preferred embodiment, a pair of opposed walls of the base member are each formed with a pair of crease lines allowing said walls to be folded outwardly and the remaining walls to fold inwardly in order to collapse the base member to the flat condition.

Conveniently, said pair of opposed walls are each formed with a pair of crease lines extending obliquely from the lower corners thereof.

Furthermore, the lid member mat be formed integrally with the base member and may comprise three walls, one wall having at least one crease line allowing it to be folded outwardly and the remaining walls to be folded inwardly.

The invention will be described in more detail, by way of example only, with reference to the accompanying drawings in which.

Figure 1:
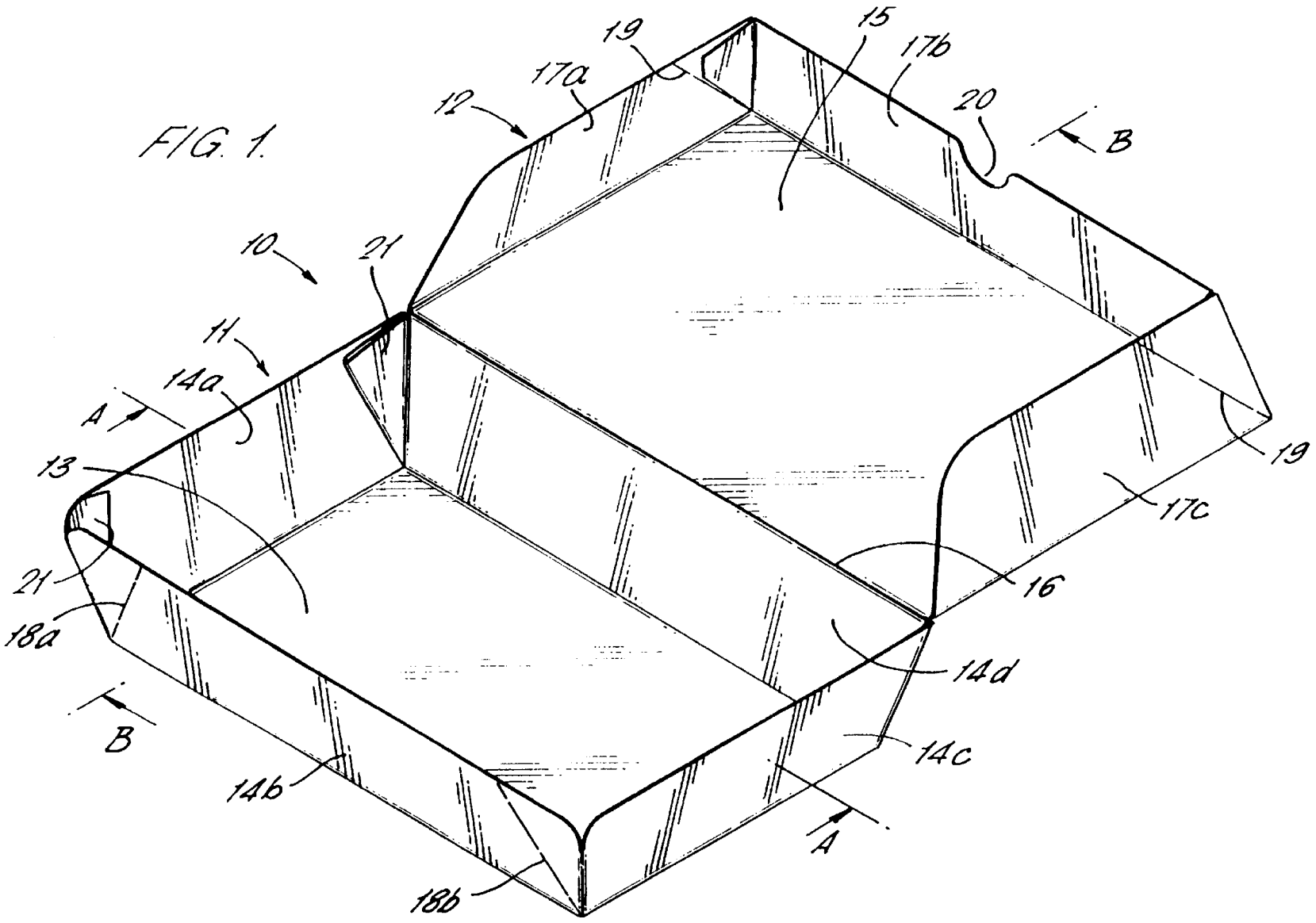
FIG. 1 is a perspective view of one embodiment in the open condition.

With reference to FIG. 1, a container 10 in accordance with one embodiment of the present invention consists of a base member 11 and lid member 12.

Figure 2:
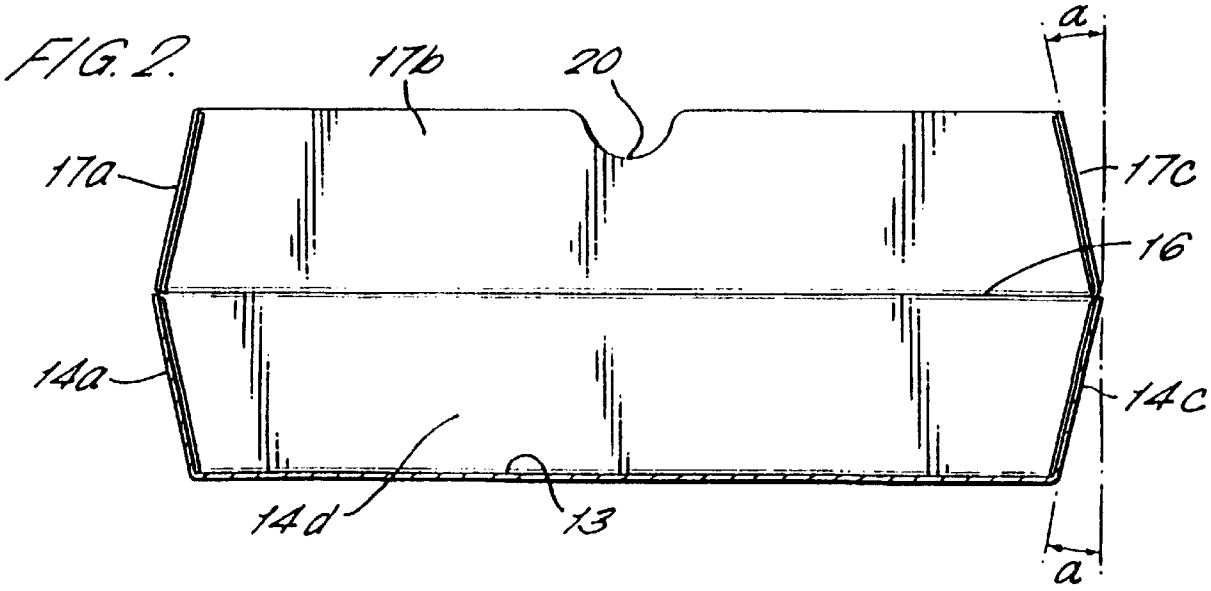
FIG. 2 is a sectional view of FIG. 1 along the line AA.
Figure 3:
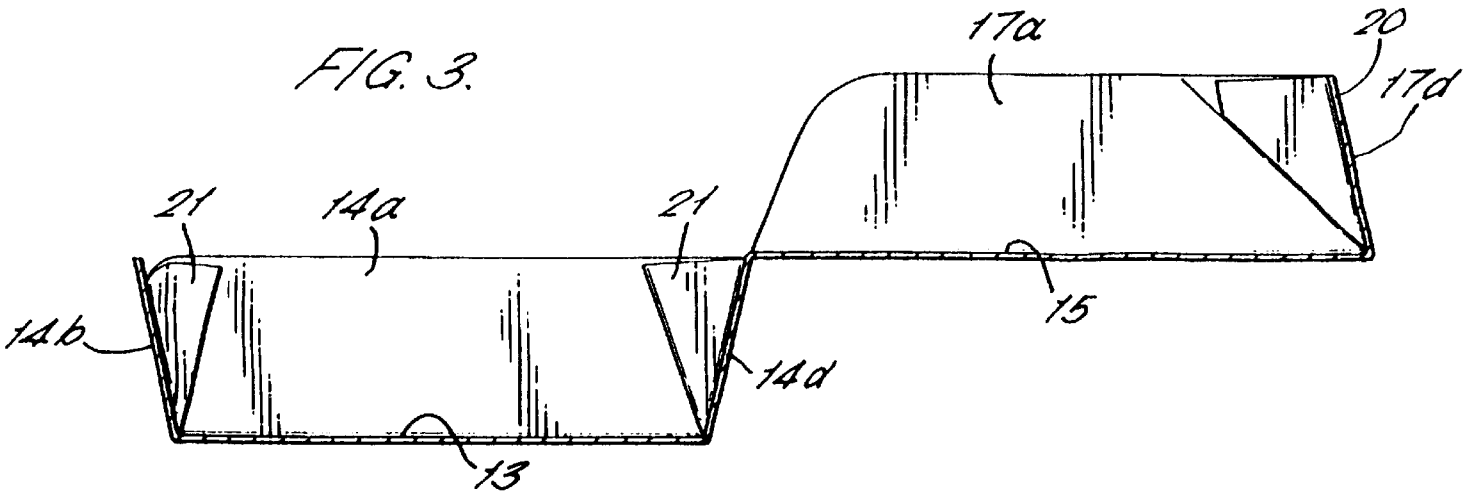
FIG. 3 is a sectional view of FIG. 1 along the line BB.

The base member 11 comprises a rectangular or square base panel 13 and four side walls 14*a, b, c* and *d,* one extending from each edge of the base panel 13. Adjacent side walls 14*a–d* are secured together at each corner. Each of the side walls 14*a–d* makes an obtuse angle, i.e greater than 90°, with the base panel 13 so that the side walls 14*a–d* taper outwardly as best seen in FIGS. 2 and 3.

The lid member 12 comprises a rectangular or square lid panel 15. One edge of the lid panel 15 adjoins one of the side walls 14*d* of the base member 11 along a hinge line 16.

Figure 4:
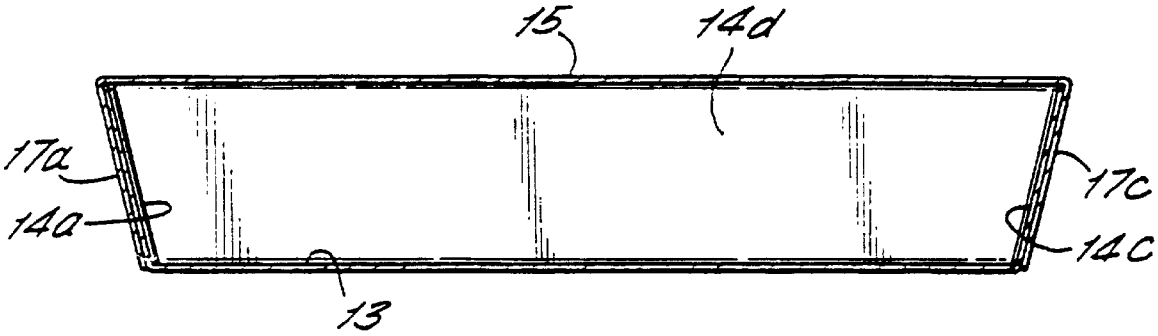
FIG. 4 is a sectional view similar to FIG. 2 but showing the container in the closed condition.
Figure 5:
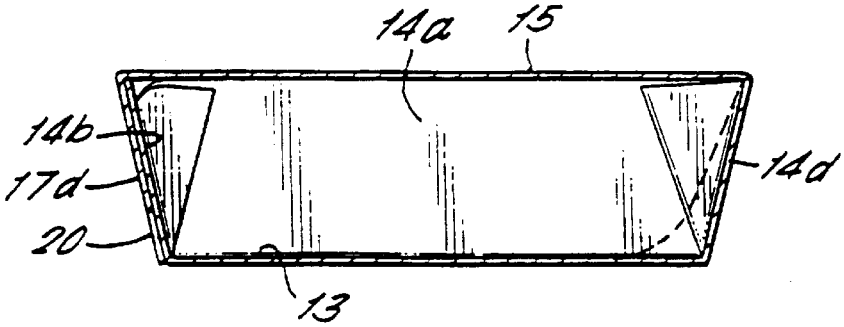
FIG. 5 is a sectional view similar to FIG. 3 but showing the container in the closed condition.

The lid member 12 is also provided with side walls 17*a, b* and *c* which extend from the remaining three edges of the lid panel 15. Each of the side walls 17*a–c* is secured to the adjacent side wall. Each of the side walls 17*a–c* makes an acute angle, i.e less than 90°, with the lid panel 15 so that the side walls 17*a–c* taper inwardly as best seen in FIGS. 3 and 4.

One of the side walls 14*b* of the base member 11 which is foremost as seen in FIG. 1 and which is opposite to the hinge line 16, is provided with crease lines 18*a* and 18*b* which extend obliquely from the respective lower corners of the side wall 14*b*. The purpose of these crease lines is discussed further below.

On the lid member 12, the opposing pair of side walls 17*a* and 17*c* are also each provided with a crease line 19 which extends obliquely from the corner which is adjacent to both the lid panel 15 and the third side wall 17*b*. Creased line 19 can also be on 17*b* side. The purpose of these crease lines is described further below.

In order to close the container 10, the lid member 12 is rotated about the hinge line 16 so that it is in a position above the base member 11.

The opposing pair of side walls 17*a* and 17*c* of the lid member 12 can be pulled outwardly to a small extent by bending at the crease lines 19. This enables the side walls 17*a* and 17*c* to be fitted over the corresponding side walls 14*a* and 14*c* of the base member 11.

To complete the closing procedure, the foremost side wall 14*b* of the base member 11 (which is opposite to the hinge line 16) can be pushed inwardly to a small extent by bending at the crease lines 18*a* and 18*b*. This action causes the opposing side walls 14*a* and 14*c* to move slightly closer to each other. This enables the foremost side wall 17*b* of the lid member 12 to be fitted over the corresponding side wall 14*b* of the base member 11.

Once in the completely closed position, the side walls 14*a–c* of the base member 11 return to their outwardly tapering configuration and the side walls 17*a–c* of the lid member 12 return to their inwardly tapering configuration. The outwardly tapering walls 14*a–c* of the base member 11 are retained within the inwardly tapering walls 17*a–c* of the lid member 12. In this way, the opposite tapers of the base member 11 and lid member 12 co-operate to retain the container securely in the closed position.

In order to reopen the container 10, the foremost side wall 14*b* of the base meter 11 can be flexed inwardly by pressing through the cutout 20 provided on the side wall 17*b* of the lid member 12 which covers it. This reduces the taper of the base member sufficiently for the lid member to be removed.

Preferably the angle a of the taper (as shown in FIG. 2) of both the side walls 14 and of the base member 11 and the side walls 17*a–c* of the lid member 12 is in the range 8°–15° and is most preferably about 11°. Within this range, it remains relatively easy to fit the lid member 12 over the base member 11 whilst, once fitted, there is sufficient resistance between the opposing tapers to retain the container securely closed.

Nevertheless, it is possible to use other taper angles if desired. Particularly, a much greater angle of taper could be used if it were desired to have a very shallow container, for example, for foodstuffs such as pizza.

The container is preferably made from a material such as stiff paper, cardboard or thin plastic which is relatively cheap and easy to handle and has a degree of resilience. However, any other suitable material could be used. The container could comprise a combination of different materials and it could also be formed as a laminate, for example to improve insulation.

If it is desired to use the container for "wet" foodstuffs which include a liquid component, for example a sauce, the container must of course be liquid tight. To achieve, this material from which the container is made may be coated with a liquid impermeable layer such as plastic. In addition, it is important to ensure that leakage cannot occur at the joints and corners of the container.

In the embodiment illustrated in FIG. 1, at each corner of the base member 11 an integral panel extends between the ends of the adjacent side walls and the base panel 13. When the walls 14*a–d* are folded so as to be upstanding from the base panel 13 and the end edges of adjacent walls are brought into contact, the panel is pushed inwardly and folded in half to form a triangular tab 21 which is of double thickness compared to the walls themselves. This triangular tab 21 may be secured against the internal surface of one wall by adhesive, for example as seen in FIG. 1 the tab 21 formed between walls 14*a* and 14*d* may be secured against the internal surface of side wall 14*a*. This type of joint is sometimes referred to as a "Z folded" joint. In this way, the side walls 14*a–d* and the base panel 13 of the base member 11 are continuous with each other and there are no gaps at the joints and corners where leakage could occur.

A similar arrangement may be used if desired in the lid member 12.

A member of other modifications to the container described will be apparent to those skilled in the art.

For example, although the embodiment illustrated is a one-piece item with the lid member and base member integrally formed, a container comprising separate lid and base members could be produced.

In addition, although the embodiment described shows the base and lid panels 13 and 15 to be rectangular, other shapes could be constructed. For example, the base and lid panels could be other polygonal shapes such as square or octagonal and it is also conceivable that the base and lid walls could be substantially circular or elliptical. In this case, the base member and lid member could be separate items each having a single side wall surrounding the base or lid panel in the form of a truncated cone, the base member having a fold or pleat enabling the diameter of the cone to be reduced for fitting within the lid member.

Furthermore, the embodiment illustrated shows the side walls 17*a–c* of the lid member 12 to be of the same depth as the side walls 14*a–d* of the base member 11. However, the side walls 14*a–d* of the base member 11 could be significantly deeper to give the container 10 a greater volume while the side walls 17*a–c* of the lid member 12 would then overlap only an upper portion of the side walls 14*a–c* of the base member 11 in the closed condition.

Turning now to FIGS. 6–9, a second embodiment of the invention is described, using like reference numerals for like parts. In the container according to the second embodiment, additional crease lines are provided in order to allow the container to be flattened for convenient storage before use.

Figure 6:
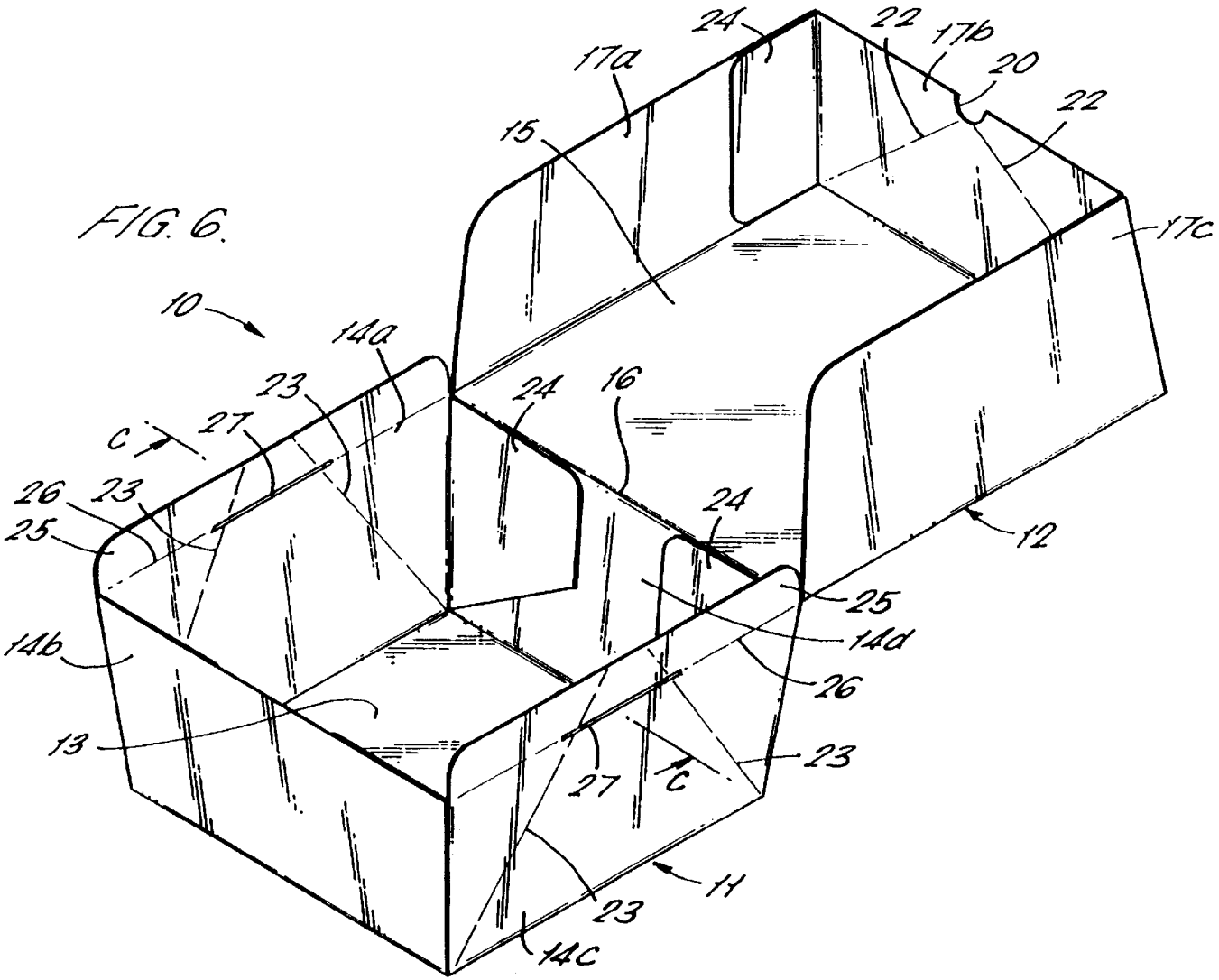
FIG. 6 is a perspective view of a second embodiment of the invention in the open condition.

As shown in FIG. 6, the second embodiment, like the first, comprises a base member 11 having a base panel 13 and four side walls 14*a–d* which taper outwardly from the base member 13.

Figure 9:
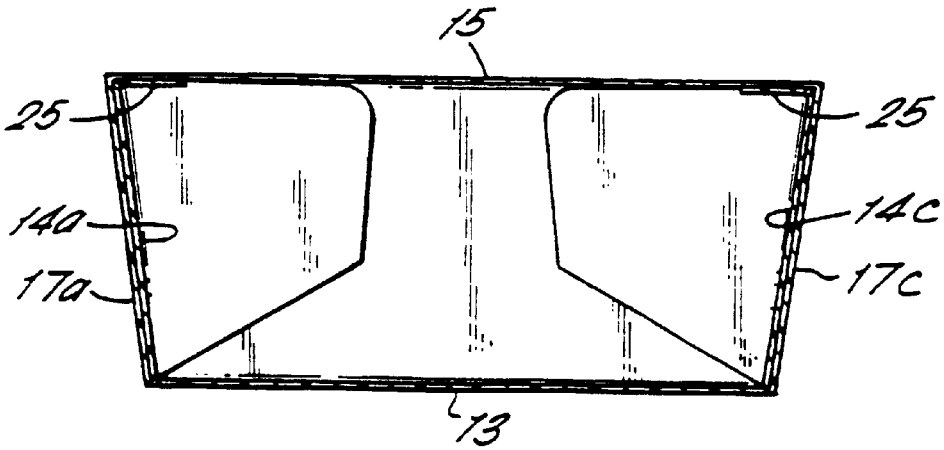
FIG. 9 is a cross-section similar to FIG. 8 but with the container in the closed condition.

The container 10 further comprises a lid member 12 having a lid panel 15 which adjoins one side wall 14*d* of the base member 11 along a hinge line 16. Three inwardly tapering side walls 17*a–c* extend from the other three edges of the lid panel 15. In use, these inwardly tapering walls 17*a–c* fit over the corresponding outwardly tapering walls 14*a–c* of the base member 11 in order to retain the container 10 in the closed position, as seen in FIG. 9.

The difference between the first and second embodiments of the invention is that in the second embodiment the side wall 17*b* of the lid member 12 is formed with two crease lines 22, each of which extends obliquely from the corner where the wall 17*b* meets the lid panel 15 and the adjacent side walls 17*a* or 17*c* towards the finger cut-out 20 which is positioned in the centre of the free edge of side wall 17*b*.

In addition, the opposing side walls 14*a* and 14*c* of the base member 11 are also each formed with a pair of crease lines 23. Each crease line 23 extends obliquely from the lower corner of the respective side wall where it adjoins the base panel 13 and the adjacent side wall. Thus, the two crease lines 23 in each wall converge towards the upper edge of the wall but do not meet.

This arrangement of crease lines 22,23 allows the container 10 to be folded flat. To achieve this, the opposing side walls 17*a* and *c* of the lid member 12 are folded in towards each other and towards the lid panel 15. The crease lines 22 of the lid member 12 allow the remaining wall 17*b* to fold outwardly, away from the lid panel 15, thus collapsing the lid member 12 into a substantially flat condition.

Figure 7:
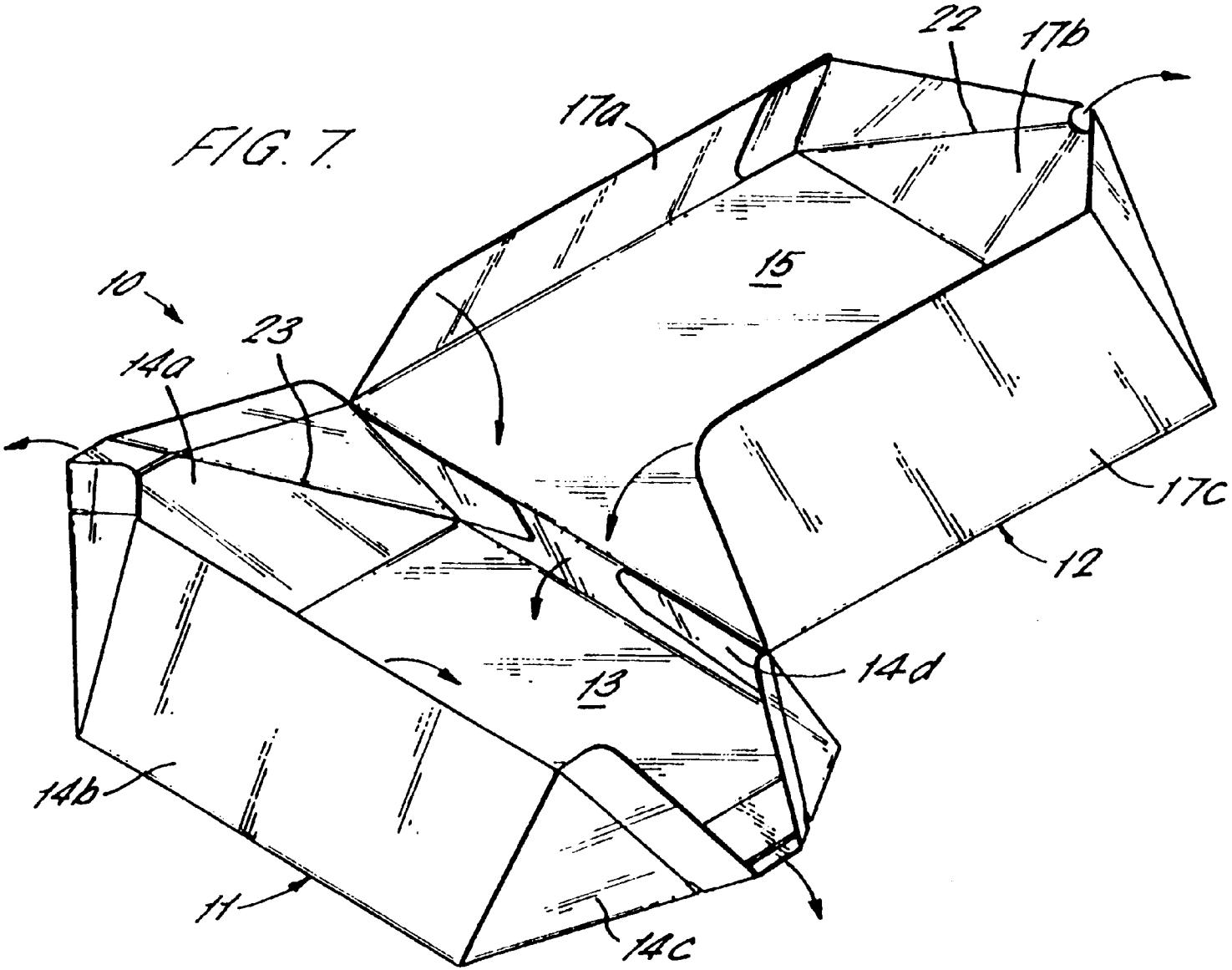
FIG. 7 is a perspective view of the second embodiment part way between the open condition and the flat-folded condition.
Figure 8:
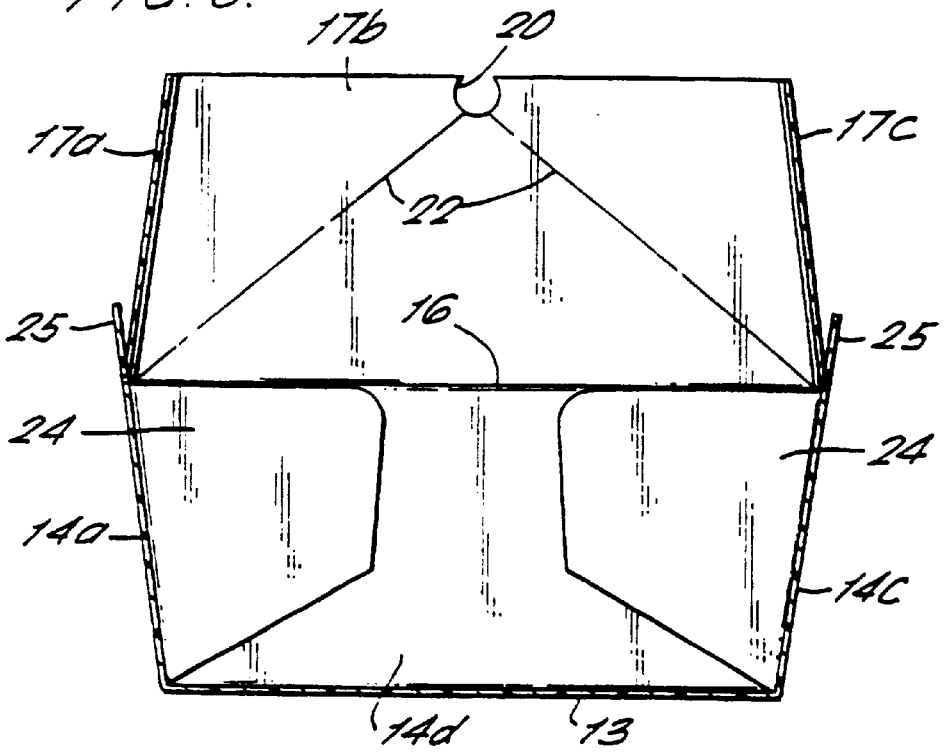
FIG. 8 is a cross-section of the container of FIG. 6 taken along the line CC when the container is in the open condition.

Meanwhile, the front and rear walls 14*b* and 14*d* of the base member 11 can be folded inwardly towards each other and towards the base panel 13. As this happens, the crease lines 23 allow the remaining side walls 14*a* and 14*c* to fold outwardly away from the base panel 13. This folding process is illustrated in FIG. 7 which shows the container at a point when it has been partially flattened.

The end result is that the whole container 10 can be collapsed into a substantially flat condition for convenient and space efficient storage. Nevertheless, the container 10 is quickly ready for use simply by pulling the side walls 17*a* and 17*c* away from lid member 15 and pulling the side walls 14*b* and 14*d* away from the base member 13, thereby bringing the remaining walls 17*b* and 14*a* and 14*c* back up, in order to create the box form container 10 in the open condition as illustrated in, FIG. 6. It will be apparent to one skilled in the art that the precise configuration of the crease lines may be altered as desired provided that the container is still capable of being folded substantially flat.

The other difference between the first and second embodiments of the invention is the formation of the joints between adjacent side walls. As described previously, if the container is to be used to hold liquids it must be formed such that the side walls 14*a–d* and base panel 13 are all integral with one another so that no holes are left at any corners. However, if only dry goods are to be contained, such joints are unnecessary. By way of example, the second embodiment illustrated in FIGS. 6–9 is shown with simpler non-liquid tight joints.

As best seen in FIG. 6, each side wall 14*a–d* and 17*a–c* is not formed integrally with the adjacent walls. Instead, at each corner of the container, just one of the walls is provided with a flap 24. When the side walls are folded so as to be upstanding from the base member 13, the flaps 24 are secured, for example by adhesive, to the adjacent walls. Thus, as seen in FIG. 6, wall 14*a* may be provided with a flap 24 at each end. Then the container 10 is assembled, one flap 24 is secured to the interior surface of side wall 14*d* and the other is secured to the interior surface of side wall 14*b*. Similarly, on the lid member, wall 17*b* may be provided with flaps 24 which when assembled are respectively secured to the other side walls 17*a* and 17*c*. All flaps 24 can also be pasted on the outside of box.

A further optional feature is illustrated in the second embodiment of the invention, although it can be included in any embodiment. As seen in FIG. 6, flaps 25 are provided adjoining the top edges of the opposing said walls 14*a* and 14*c*. The hinge line 26 which is formed between each flap 25 and the respective wall may be partially cut through to provide a slit 27 which aids folding of the container 10. In a closed condition, the flaps 25 are folded inwardly as shown in FIG. 9 so as not to obstruct the side walls 17*a* and 17*c* of the lid ember 12.

Prom the foregoing it is clear that the present invention provides an improved container which is simple to close and which can be securely retained in the closed condition without the need for additional securing means. The container can also be tacked with like containers or other items without the weight causing opening or crushing of the container. Instead, the angle a of the tapers of both lid and base members tends to increase thereby forcing the outwardly tapering walls of the base member more tightly against the inwardly tapering walls of the lid member. Alternatively the container can be capable of being folded flat for most space-efficient storage before use. The container can be formed with leak proof joints in order to hold wet as wall as dry goods and the shape and volume of the container can be altered to suit the intended use.

What is claimed is:

1. A container having a one-piece construction comprising a base member having adjacent walls and a lid member having adjacent walls connected to each other and co-operable to form a closed container, wherein the base member comprises at least one outwardly tapering wall and a base panel and the lid member comprises at least one inwardly tapering wall and a lid panel and wherein means is provided to allow either the outwardly tapering wall to flex inwardly or the inwardly tapering wall to flex outwardly so as to enable the inwardly tapering wall to be fitted over the outwardly tapering wall.

2. A container as claimed in claim 1, wherein the means to allow flexing comprises at least one crease line formed in the wall to be flexed.

3. A container as claimed in claim 1, wherein the base member comprises at least three outwardly tapering walls.

4. A container as claimed in claim 3 wherein the lid member comprises at least three inwardly tapering walls.

5. A container as claimed in claim 1, wherein the outwardly tapering wall tapers at an angle in the range of 8 to 15°.

6. A container as claimed in claim 5, wherein the outwardly tapering wall tapers at an angle of about 11°.

7. A container as claimed in claim 1, wherein the inwardly tapering wall tapers at an angle in the range of 8 to 15°.

8. A container as claimed in claim 7, wherein the inwardly tapering wall tapers at an angle of about 11°.

9. A container as claimed in claim 1, wherein the base member and the lid member are integral with one another, being joined along a hinge line.

10. A container as claimed in any preceding claim 1, wherein the depth of the outwardly tapering wall is substantially equal to the depth of the inwardly tapering wall.

11. A container as claimed in claim 1, wherein the depth of the outwardly tapering wall is substantially greater than the depth of the inwardly tapering wall.

12. A container as claimed in claim 1, wherein the container is made from stiff paper or cardboard.

13. A container as claimed in claim 10, wherein the container in formed from plastics material.

14. A container as claimed in any preceding claim, wherein the container is formed from a combination of different materials.

15. A container as claimed in claim 1, wherein the container is formed from a laminated material.

16. A container as claimed in claim 1, wherein each wall of the base member is formed integrally with each adjacent wall and with a base panel.

17. A container as claimed in claim 1, wherein each wall of the lid member is formed integrally with each adjacent wall and with a lid panel.

18. A container as claimed in claim 16, wherein adjacent walls are formed integrally with one another and with the base panel or lid panel respectively by means of an additional panel extending therebetween.

19. A container as claimed in claim 1, wherein at each corner of the container, one wall is formed with a flap which is attachable to the adjacent wall in order to form a corner joint.

20. A container as claimed in claim 1, further comprising means to allow the container to be collapsed into a substantially flat condition.

21. A container as claimed in claim 20, wherein the means to allow the container to collapse comprises at least one crease line formed in at least one wall of the lid member and of the base member.

22. A container as claimed in claim 21, wherein a pair of opposing walls of the base meter are each formed with at least one crease line allowing said walls to be folded outwardly and the remaining walls to fold inwardly in order to collapse the base member to a substantially flat condition.

23. A container as claimed in claim 22, wherein said pair of opposed walls are each formed with a pair of crease lines extending obliquely from the lower corners thereof.

24. A container as claimed in any of claims 20, wherein the lid member is formed integrally with the base member and the lid ark comprises three walls, one wall having at least one crease line allowing it to be folded outwardly and the remaining walls to be folded inwardly.

* * * * *